US007942013B2

(12) United States Patent
Kim

(10) Patent No.: US 7,942,013 B2
(45) Date of Patent: May 17, 2011

(54) DISPLAY FOR REFRIGERATOR AND DISPLAY MOUNTING FRAME, DISPLAY MOUNTING STRUCTURE COMPRISING THE SAME

(75) Inventor: Ung-Su Kim, Gimhae (KR)

(73) Assignee: LG Electronics Inc., Seoul (KR)

( * ) Notice: Subject to any disclaimer, the term of this patent is extended or adjusted under 35 U.S.C. 154(b) by 378 days.

(21) Appl. No.: 12/160,081

(22) PCT Filed: Jan. 3, 2007

(86) PCT No.: PCT/KR2007/000036

§ 371 (c)(1),
(2), (4) Date: Jul. 3, 2008

(87) PCT Pub. No.: WO2007/078149

PCT Pub. Date: Jul. 12, 2007

(65) Prior Publication Data

US 2008/0297019 A1 Dec. 4, 2008

(30) Foreign Application Priority Data

Jan. 3, 2006 (KR) ..... 10-2006-0000628
Jan. 3, 2006 (KR) ..... 10-2006-0000629

(51) Int. Cl.
*F25B 49/00* (2006.01)
*F25D 11/02* (2006.01)
*F25D 19/00* (2006.01)

(52) U.S. Cl. ..... 62/125; 62/444; 62/449

(58) Field of Classification Search ..... 62/125, 62/440, 441, 444, 449; 374/208; 312/405; 248/466
See application file for complete search history.

(56) References Cited

U.S. PATENT DOCUMENTS

2004/0183414 A1 9/2004 Kwon

FOREIGN PATENT DOCUMENTS

| | | | |
|---|---|---|---|
| JP | 11014248 A | * | 1/1999 |
| JP | 2002-039673 A | | 2/2002 |
| JP | 2002039673 A | * | 2/2002 |
| KR | 20-1999-006540 U | | 2/1999 |

* cited by examiner

*Primary Examiner* — Chen-Wen Jiang
(74) *Attorney, Agent, or Firm* — Birch, Stewart, Kolasch & Birch, LLP

(57) ABSTRACT

The present invention is directed to a display for a refrigerator, comprising a display case mounted to a display mounting portion provided to a front surface of a refrigerator door and provided with a predetermined installation space therein; a printed circuit board (PCB) installed to the display case and including an input portion for receiving various operation signals for the refrigerator and a display portion for displaying a variety of operating information for the refrigerator; and a display cover provided to one side of the PCB and defining a front surface of the display. According to the present invention, there are advantages in that errors occurring at an installation process can be minimized, the assembly and installation processes can be more easily made, and the repair and exchange can also be easily performed.

10 Claims, 6 Drawing Sheets

DISPLAY FOR REFRIGERATOR AND DISPLAY MOUNTING FRAME, DISPLAY MOUNTING STRUCTURE COMPRISING THE SAME

TECHNICAL FIELD

The present invention relates to a refrigerator, and more particularly, to a display for a refrigerator capable of receiving operating signals for the refrigerator and displaying a variety of operating information for the refrigerator, a display mounting frame, and a display mounting structure comprising the same.

BACKGROUND ART

FIG. 7 is a perspective view of a refrigerator equipped with a related art display mounting structure for a refrigerator, and FIG. 8 is an exploded perspective view of the related art display mounting structure for a refrigerator.

As shown in the figures, a storage space (not shown) is provided in a main body 10 of a refrigerator. Further, a pair of doors 11 and 13 for selectively opening and/or closing the storage space are pivotally installed at both ends of the refrigerator body 10, respectively, such that one lateral end of each door can be moved with respect to the other lateral end of the relevant door.

The right door 11 of FIG. 7 is provided with a display 15 and a dispenser 19. The display 15 receives various operation signals for the refrigerator and displays a variety of operating information for the refrigerator. Further, the dispenser 19 is used to allow a user to take water or ice out of the refrigerator without opening the doors 11 and 13.

In addition, the left door 13 of FIG. 7 is provided with a home bar 17. The home bar 17 is used for allowing a user to take foods in or out of the refrigerator without opening the doors 11 and 13 and is selectively opened or closed by means of a home bar door 18.

Meanwhile, as shown in FIG. 8, a display accommodating portion 11A is provided at a specific position on a front surface of the door 11. The display accommodating portion 11A is formed by depressing a portion of the front surface of the door 11 in a rear direction. The display 15 includes a printed circuit board (PCB) 15A provided with a variety of electric elements thereon, and a display cover 15B defining a front surface thereof. Further, the display 15 receives operating signals in touch screen mode. In addition, the display accommodating portion 11A is covered with an outer cover member 11B defining a front external appearance of the door 11 in a state where the display 15 is accommodated therein.

Now, a process of assembling a related art refrigerator door will be discussed. In a state where the door 11 is first assembled, the display 15 is accommodated in the display accommodating portion 11A. At this time, the display 15 is assembled in such a manner that the PCB 15A and the display cover 15B of the display 15 are sequentially accommodated into the display accommodating portion 11A.

However, the related art display mounting structure for a refrigerator has the following problems.

As described above, the display 15 is assembled in such a manner that the PCB 15A and the display cover 15B are mounted to the display accommodating portion 11A. Therefore, there is a problem in that high possibility of errors occurring while assembling and installing the display 15 in the display accommodating portion 11A leads to an increase in percentage defective of products.

In addition, since the display 15 is assembled in the process of manufacturing a refrigerator as described above, the overall process of manufacturing a refrigerator is complicated, and a process of assembling a refrigerator cannot be progressed due to the failure of the display 15. Thus, it is likely that manufacturing costs of refrigerators may be substantially increased due to the man-hour increase and the assembling process delay.

Moreover, in a case where any failure occurs in respective parts, particularly in the PCB 15A, of the display 15, the display cover 15B should be first separated from the display accommodating portion 11A. Therefore, there is another problem in that it is convenient to repair or exchange the display 15.

DISCLOSURE

Technical Problem

The present invention has been conceived to solve the aforementioned problems in the prior art. Accordingly, an object of the present invention is to provide a display for a refrigerator capable of minimizing errors occurring at an installation process, a display mounting frame, and a display mounting structure including the same.

Another object of the present invention is to provide a display for a refrigerator which can be easily installed, a display mounting frame, and a display mounting structure including the same.

A further object of the present invention is to provide a display for a refrigerator which can be repaired and exchanged, a display mounting frame, and a display mounting structure including the same.

Technical Solution

According to an aspect of the present invention for achieving the above objects, there is provided a display for a refrigerator, comprising: a display case mounted to a display mounting portion provided to a front surface of a refrigerator door and provided with a predetermined installation space therein; a printed circuit board (PCB) installed to the display case and including an input portion for receiving various operation signals for the refrigerator and a display portion for displaying a variety of operating information for the refrigerator; and a display cover provided to one side of the PCB and defining a front surface of the display.

In one embodiment of the invention, at least one through hole through which a fastener coupled to the display mounting portion penetrates is formed at one side of the display case.

Preferably, a male or female connector is provided to a position on the display case such that the male or female connector is connected to a corresponding female or male connector provided to the display mounting portion and thus connected to a main controller of the refrigerator.

More preferably, the display mounting portion is integrally formed with a mounting frame which includes a home bar frame portion provided to the door to define a home bar opening.

According to another aspect of the present invention for achieving the objects, there is provided a mounting frame for a display in a refrigerator, comprising: a home bar frame portion provided to a refrigerator door and formed with a home bar opening through which foods are taken in or out of a home bar; and a display mounting portion provided to one side of the home bar frame portion and mounted with the display which is provided to the refrigerator door to receive various operation signals for the refrigerator and display operating information for the refrigerator.

In another embodiment of the invention, the mounting frame is mounted to a cut-out portion formed by cutting out a portion of a front surface of the door, and a front surface of the home bar frame portion is brought into close contact with a back side of an outer cover member which is provided to a front surface of an outdoor.

Preferably, the display receives operation signals for the refrigerator in touch screen mode.

More preferably, the home bar opening communicates with an accommodation space defined in a home bar housing provided to a rear surface of the door.

In another embodiment of the invention, the display mounting portion is formed into a shape corresponding to the display by depressing a portion of the home bar frame portion inwardly of the door and is covered with an outer cover member provided to a front surface of the door.

Preferably, a female or male connector is provided to a position on the display mounting portion such that the female or male connector is connected to a corresponding male of female connector provided to the display to connect the display to a main controller of the refrigerator.

In another embodiment of the invention, a state where the display mounting portion is covered with an outer cover member provided to a front surface of an outdoor, a front surface of the home bar frame portion is brought into close contact with a back side of the outer cover member.

According to another aspect of the present invention for achieving the objects, there is provided a display mounting structure, comprising: a display for receiving various operation signals for a refrigerator and displaying operating information for a refrigerator and a mounting frame for mounting the display.

Advantageous Effects

According to the present invention so configured, there are advantages in that errors occurring at an installation process can be minimized, the assembly and installation processes can be more easily made, and the repair and exchange can also be easily performed.

BEST MODE

Hereinafter, a display mounting structure for a refrigerator according to preferred embodiments of the present invention will be described in detail with reference to the accompanying drawings.

Figure 1:
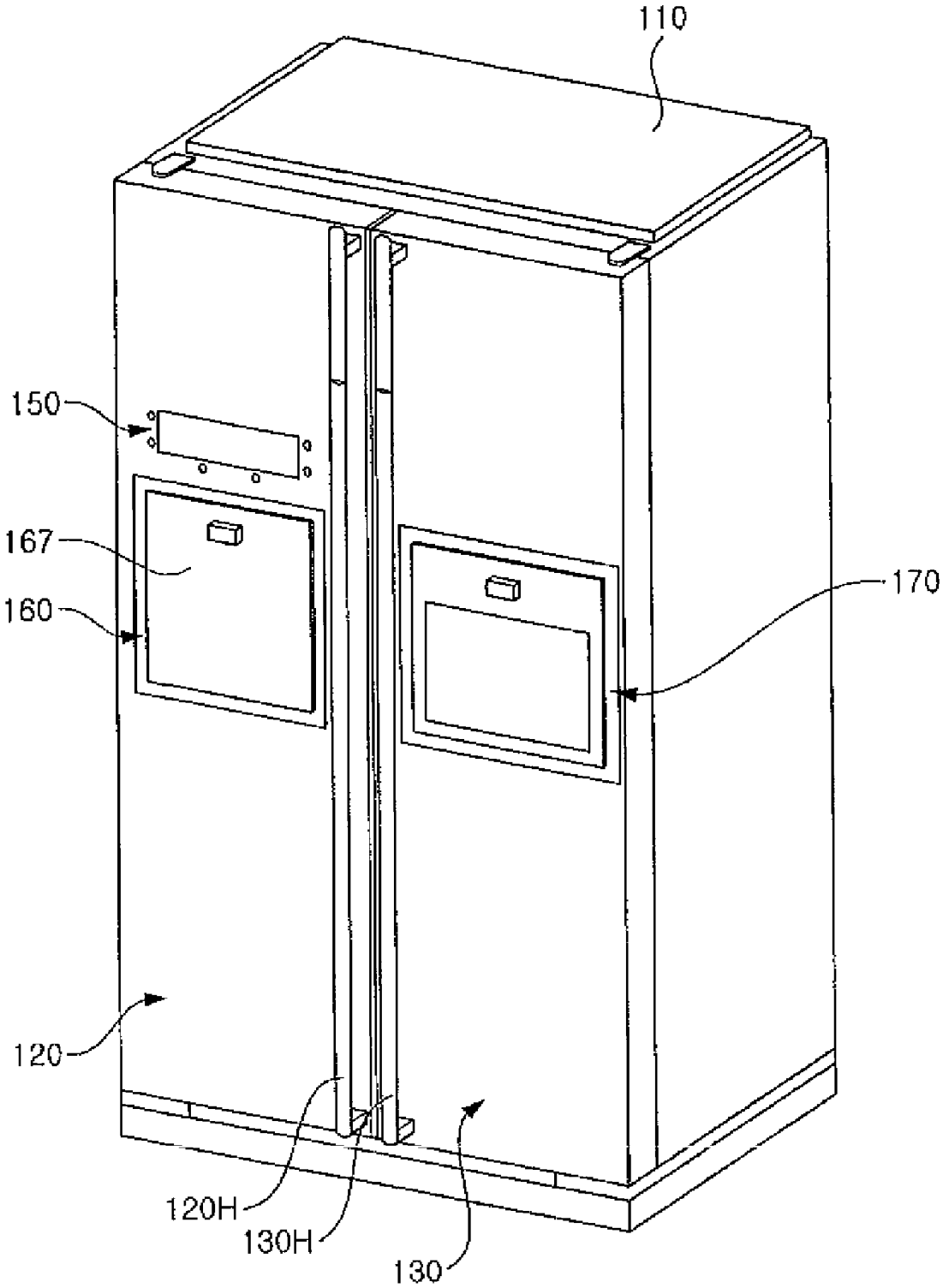
FIG. 1 is a perspective view of a refrigerator equipped with a display mounting structure according to a preferred embodiment of the present invention.
Figure 2:
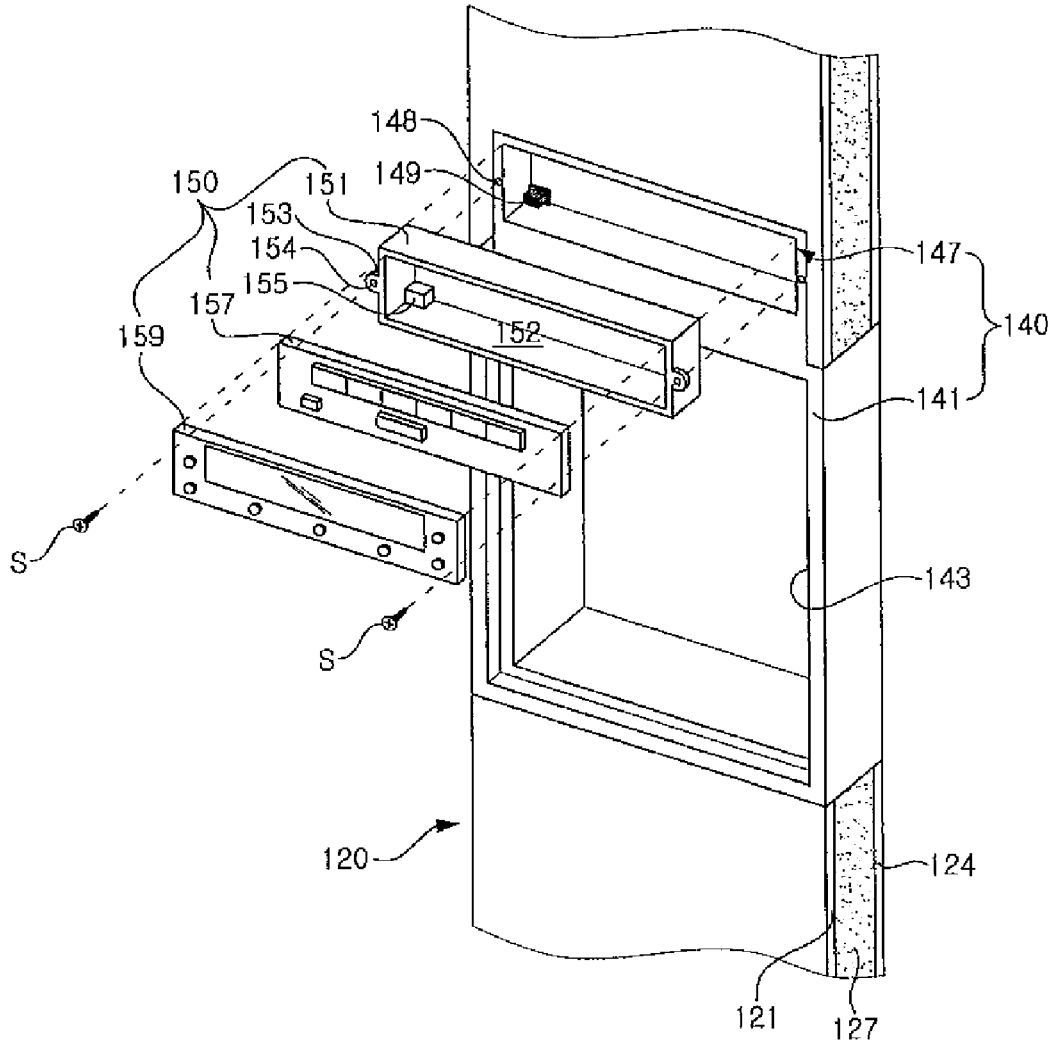
FIG. 2 is an exploded perspective view of the display mounting structure according to the preferred embodiment of the present invention.
Figure 3:
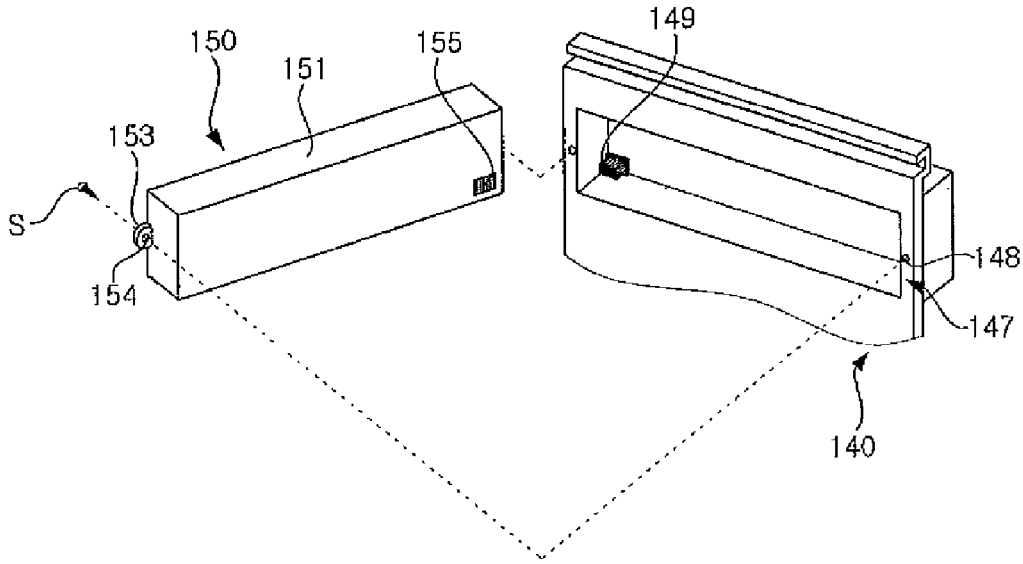
FIG. 3 is an exploded perspective view of the display mounting structure according to the preferred embodiment of the present invention, which is seen from a different angle.

FIG. 1 is a perspective view of a refrigerator equipped with a display mounting structure according to a preferred embodiment of the present invention; FIG. 2 is an exploded perspective view of the display mounting structure according to the preferred embodiment of the present invention; and FIG. 3 is an exploded perspective view of the display mounting structure according to the preferred embodiment of the present invention, which is seen from a different angle.

As shown in the figures, a pair of doors 120 and 130 are provided to a main body 110 of a refrigerator to selectively open or close a storage space (not shown) defined in the refrigerator body. The doors 120 and 130 are pivotally installed at both ends of the refrigerator body 110, respectively, such that one lateral end of each door can be moved with respect to the other lateral end of the relevant door.

As shown in FIG. 2, an outdoor 121 of the door 120 defining a front surface of the door 120 is provided with a cut-out portion 122. The cut-out portion 122 is formed by cutting out a portion of the outdoor 121 of the door in a rectangular shape. A mounting frame 140, which will be explained later, is installed in the cut-out portion 122.

Further, as shown in FIG. 2, a door liner 124 is coupled to the rear of the outdoor 121 of the door. The door liner 124 defines a rear surface of the door 120. In addition, an insulation layer 127 is provided between the outdoor 121 and the door liner 124. Furthermore, an outer cover member (not shown) defining an outer appearance of the front surface of the door 120 is provided. The outer cover member is configured such that the back side thereof is brought into close contact with the front surface of the outdoor 121 and the front surface of the mounting frame 140 to be explained later, to thereby form the outer appearance of the front surface of the door 120.

Furthermore, the mounting frame 140 is installed in the cut-out portion 122. A home bar frame portion 141 of the mounting frame 140 is formed into a rectangular shape. The home bar frame portion 141 is formed into a part of the front surface of the door 120. The front surface of the home bar frame portion 141 is brought into close contact with the back side of the outer cover member.

In addition, the home bar frame portion 141 is formed with a home bar opening 143. The home bar opening 143 is formed by partially cutting out the interior of the home bar frame portion 141 in a rectangular shape toward the door liner 124. The home bar opening 143 functions as a passage through which foods are taken into or out of a home bar 160 and 170 to be explained later.

A display mounting portion 147 of the mounting frame 140 is provided to an upper portion of the front surface of the home bar frame portion 141. The display mounting portion 147 is used for mounting a display 150 to be explained later and is formed by depressing a portion of the home bar frame portion 141 inwardly of the door 120. The display mounting portion 147 is covered with the outer cover member.

In addition, fastening holes 148 are formed in both sides of the display mounting portion 147, respectively. A fastening screw S is fastened into the fastening hole 148 to fix the display 150 mounted to the display mounting portion 147.

Further, a female connector 149 is provided in the display mounting portion 147. The female connector 149 is connected to a main controller of a refrigerator through a lead wire (not shown) such that electric power and electrical signals can be supplied to the display 150.

The display 150 is mounted to the display mounting portion 147. The display 150 receives various operation signals for the refrigerator and displays a variety of operating information for the refrigerator. The display 150 includes a display case 151, a printed circuit board (PCB) 157 and a display cover 159.

The display case 151 is substantially formed into a polyhedral shape with the open front. An installation space 152 is formed in the display case 151 such that the PCB 157 and the display cover 159 can be installed therein. In addition, fastening ribs 153 are provided to both sides of the display case 151. A through hole 154 through which the fastening screw S fastened to the fastening hole 148 penetrates is formed in the fastening rib 153. Further, a male connector 155 is provided to a rear side of the display case 151. The male connector 155 is provided at a position on the rear surface of the display case 151 corresponding to the female connector 149 in a state where the display 150 is mounted into the display mounting portion 147.

The PCB 157 is provided with a variety of electric elements such as operation units and display units. The operation unit may employ several buttons for receiving a variety of operation signals for the refrigerator, while the display unit may employ a liquid crystal display (LCD) on which a variety of operating information for the refrigerator can be displayed.

Various texts, images or the like for indicating the buttons to the outside are printed on the display cover 159. Further, the display cover 159 is provided with a display window through the LCD can be exposed to the outside.

The door 120 are provided with home bars 160 and 170, respectively. Each of the home bars 160 and 170 is used for taking foods in or out of the refrigerator without opening the door 120. Specifically, the home bar 160 includes a home bar housing (not shown) and a home bar door 167. A receiving space (not shown) is provided in the home bar housing to accommodate foods which are taken in or out through the home bar opening 143. The home bar housing is detachably installed to the rear surface of the door 120, i.e. the door liner 124. Also, the home bar door 167 is pivotally installed to the door 120 to selectively open or close the home bar opening 143 in such a manner that an upper end thereof is moved with respect to a lower end thereof.

Hereinafter, a process of manufacturing the refrigerator door equipped with the display mounting structure according to a preferred embodiment of the present invention will be described.

First, the outdoor 122 and the mounting frame 140 are coupled with each other. In addition, cap decorations (not shown) and side decorations (not shown), which define external appearances of top and bottom surfaces and both side surfaces of the door 120, are coupled respectively to both top and bottom ends and both side ends of the outdoor 122 of the door. Then, foaming liquid is sprayed into a space defined rear surfaces of the outdoor 122 and the mounting frame 140 and inner surfaces of the cap and side decorations. If the sprayed foaming liquid is solidified into the insulation layer 127, the door liner 124 is coupled to the rear of the outdoor 122 of the door.

Furthermore, a previously fabricated display 150 is mounted to the display mounting portion 147. At the same time, the male connector 155 of the display 150 is connected to the female connector 149 of the display mounting portion 147. In addition, the fastening hole 148 of the display mounting portion 147 is aligned with the through hole 154 of the display 150. In such a state, the fastening screw S penetrates through the through hole 154 and then is fastened into the fastening hole 148, so that the display 150 can be mounted and fixed into the display mounting portion 147.

Further, after that the display 150 has been completely mounted, other components of the door 120 such as the outer cover members, the home bar housing and the home bar door 167 are mounted. An order of installing the outer cover members, the home bar housing and the home bar door may be changed for convenience of workers, if desired.

The scope of the present invention is not limited to the above embodiment but defined by the appended claims. It is also apparent to those skilled in the art that the various modifications and changes can be made thereto in various ways within the scope of the appended claims.

MODE FOR INVENTION

Hereinafter, a display mounting structure for a refrigerator according to another embodiment of the present invention will be described with reference to the accompanying drawings.

Figure 4:
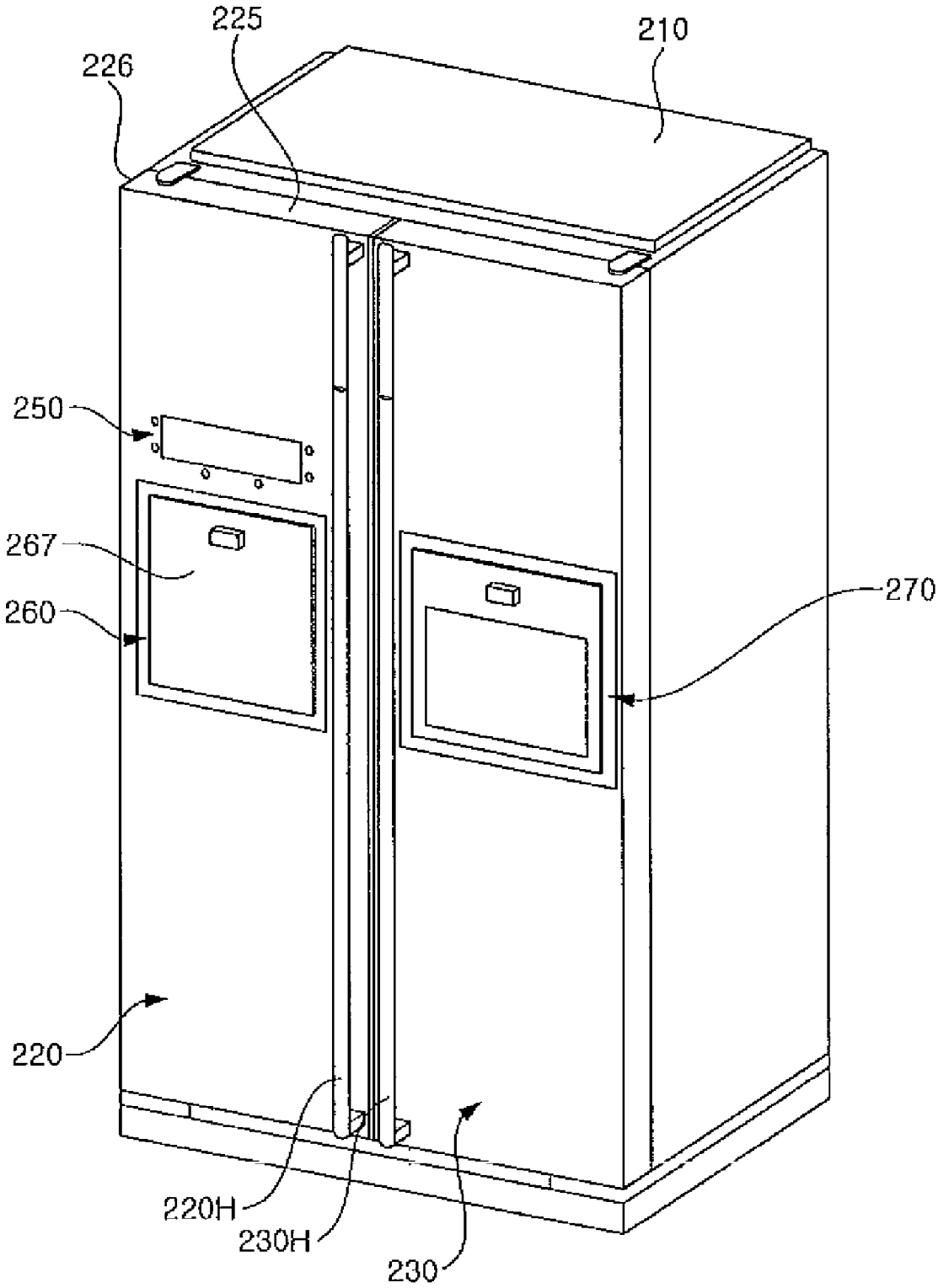
FIG. 4 is a perspective view of a refrigerator equipped with a display mounting structure according to another embodiment of the present invention.
Figure 5:
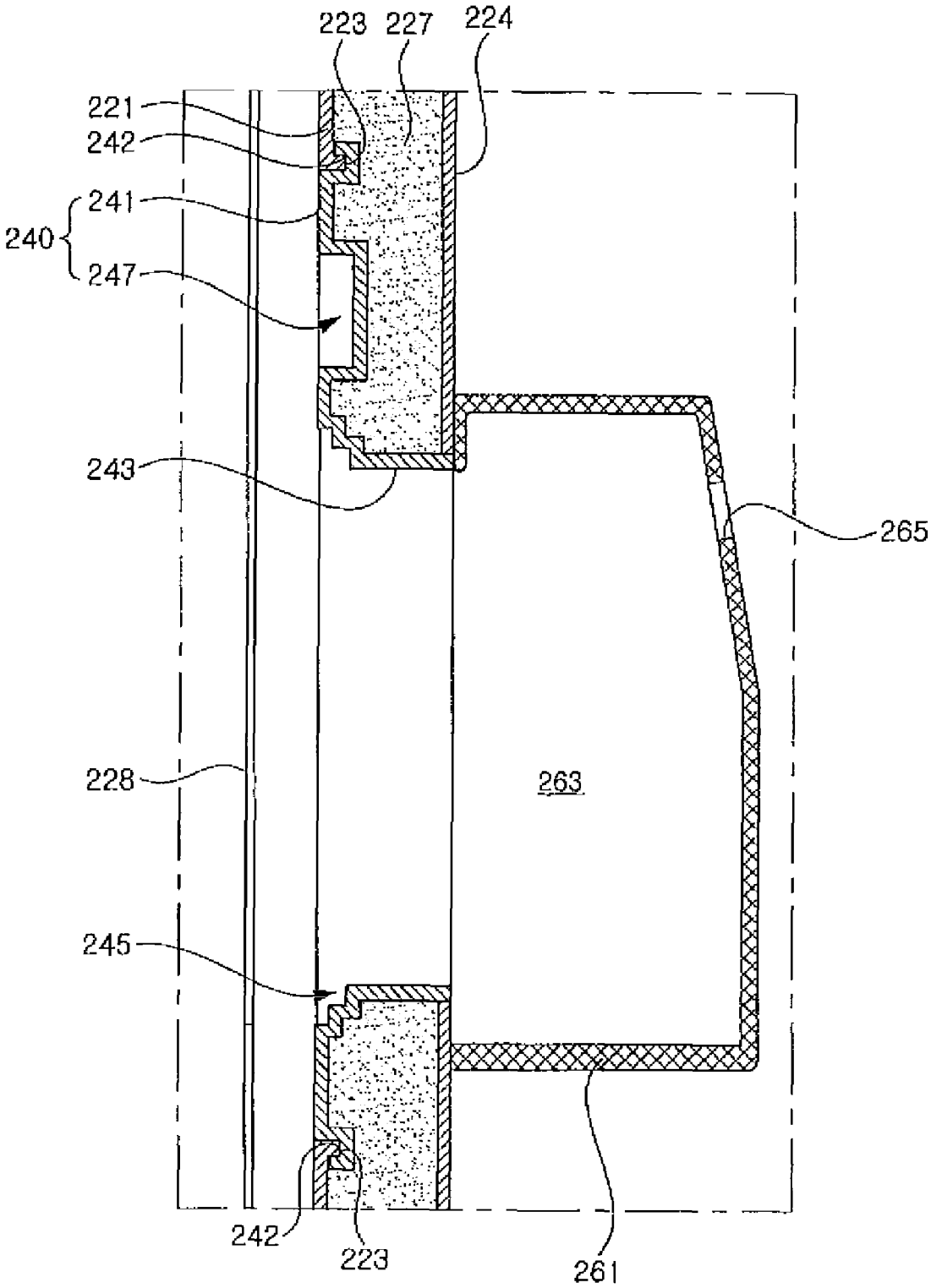
FIG. 5 is a longitudinal sectional view of the display mounting structure according to another embodiment of the present invention.

FIG. 4 is a perspective view of a refrigerator equipped with a display mounting structure according to another embodiment of the present invention; FIG. 5 is a longitudinal sectional view of the display mounting structure according to another embodiment of the present invention; and FIG. 5 is an exploded perspective view showing essential parts of the display mounting structure according to another embodiment of the present invention.

As shown in the figures, a pair of doors 220 and 230 are provided to a main body 210 of a refrigerator. The doors 220 and 230 selectively open or close a storage space (not shown) defined in the refrigerator body 210. To this end, the doors 220 and 230 are pivotally installed to both sides of the refrigerator body 210, respectively, such that one lateral end of each door can be moved with respect to the other later end of the relevant door.

As shown in FIG. 5, an outdoor 221 of the door defining a front surface of the door 220 is provided with a cut-out portion 222. The cut-out portion 222 is a part where a mounting frame 240 to be explained later is installed. The outdoor 222 of the door is provided with a fixing rib 223. The fixing rib 223 is fitted into a fixing channel 242, which will be explained later, to fix a mounting frame 240 to the outdoor. The fixing rib 223 is formed by bending a portion of the outdoor 222 adjacent to a peripheral edge of the cut-out portion 222 inwardly of the door 220, i.e. in a rightward direction as viewed on the figure.

In addition, a door liner 224 is coupled to a right portion on the figure corresponding to the rear of the outdoor 222. The door liner 224 substantially defines a rear surface of the door 220. Referring again to FIG. 4, cap decorations 225 and side decorations 226 define both top and bottom surfaces and both side surfaces of the door 220, respectively. In addition, an insulation layer 227 is provided between the outdoor 221, the door liner 224, the cap decorations 225 and the side decorations 226, i.e. within the interior of the door 220. Further, door handles 220H and 230H gripped by a user are provided to the doors 220 and 230, respectively.

An outer cover member 228 defines an external appearance of a front surface of the door 220. One or more sheets of glass or transparent member may be used as the outer cover member 228. A display mounting portion 247 to which a display 250 to be explained later is mounted is substantially covered with the outer cover member 228.

Meanwhile, the mounting frame 240 is provided in the cut-out portion 222. The mounting frame 240 is used for forming a home bar opening 243 as well as for mounting the display 250. To this end, the mounting frame 240 includes a home bar frame portion 241 and the display mounting portion 247.

Figure 6:
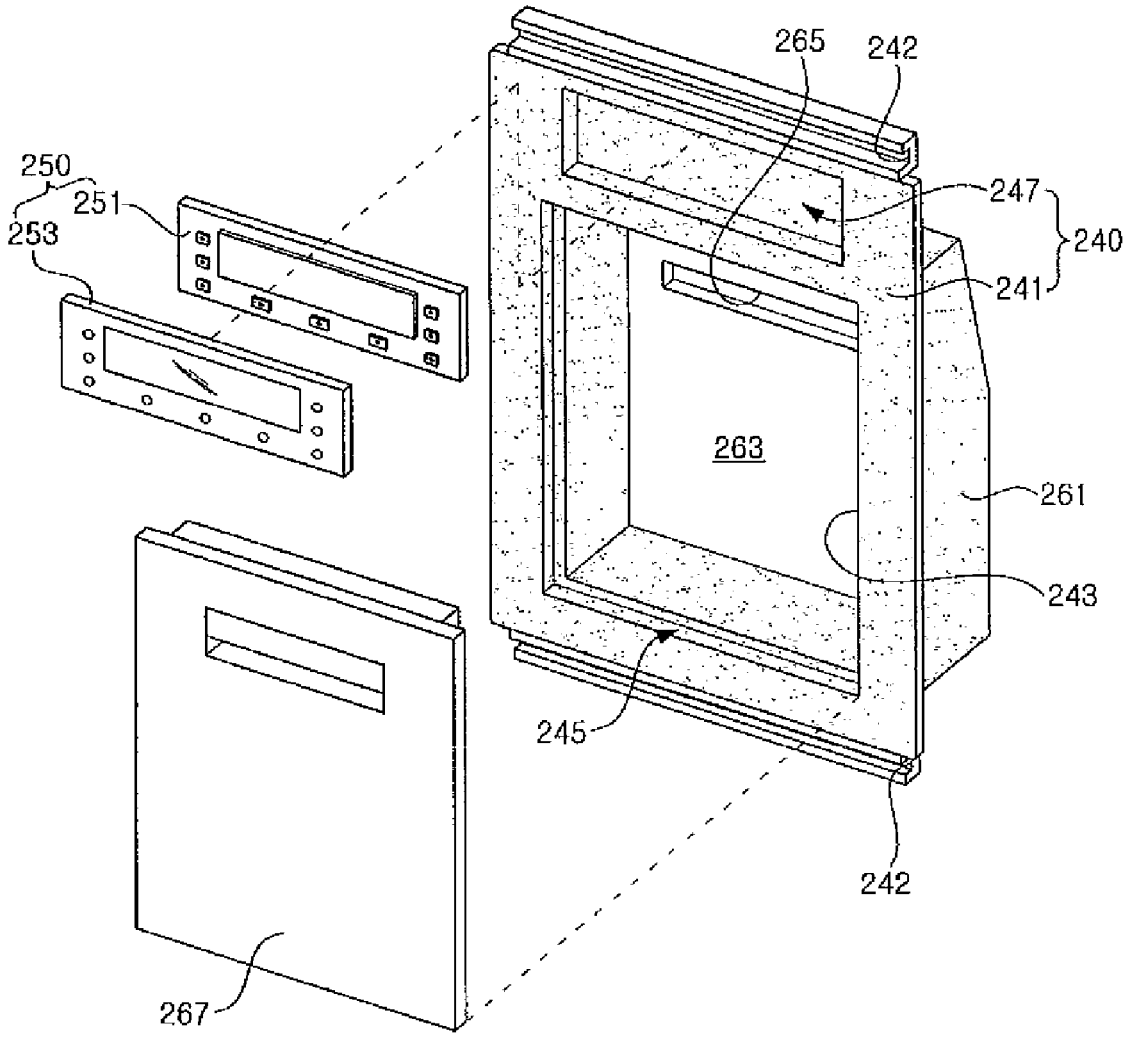
FIG. 6 is an exploded perspective view showing essential parts of the display mounting structure according to another embodiment of the present invention.
Figure 7:
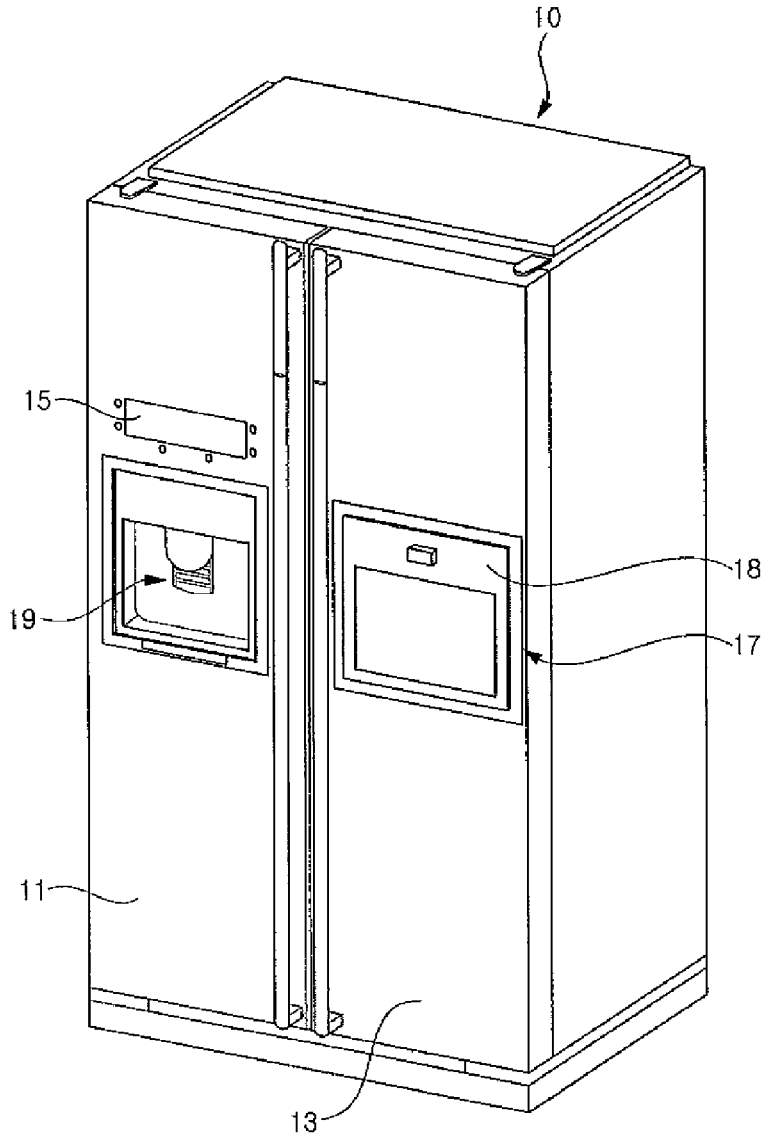
FIG. 7 is a perspective view of a refrigerator equipped with a related art display mounting structure.
Figure 8:
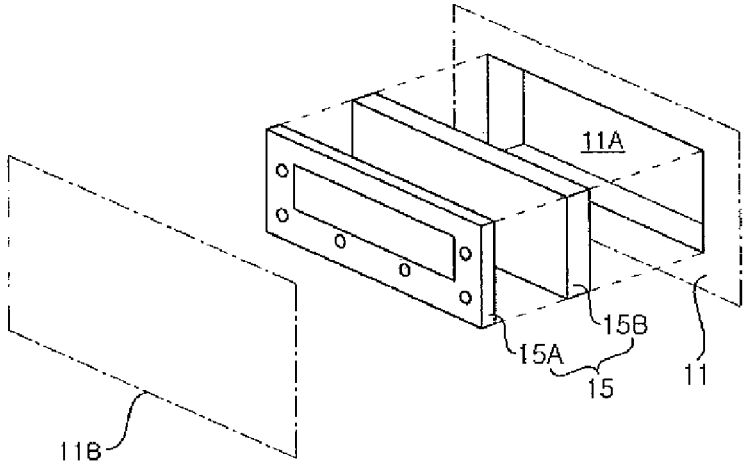
FIG. 8 is an exploded perspective view of the related art display mounting structure for a refrigerator.

The home bar frame portion 241 substantially defines a portion of the front surface of the door 220. As shown in FIG. 6, the home bar frame portion 241 is generally formed into a rectangular shape. The front surface of the home bar frame portion 241 is brought into close contact with a back side of the outer cover member 228.

In addition, the home bar frame portion 241 is provided with fixing channels 242 at upper and lower ends thereof such that it can be coupled with the outdoor 222. Each of the fixing channels 242 is formed in the upper or lower end of the home bar frame portion 241 such that it is opened forwardly of the door 220. That is, the fixing rib 223 can be fitted into the fixing channel 242. It is illustrated in this illustrated embodiment that the fixing channels 242 are provided only at the upper and lower ends of the home bar frame portion 241, but it is apparent that the channels may also be provided to both side ends of the home bar frame portion 241.

Further, a home bar opening 243 is formed at the center of the home bar frame portion 241. The home bar opening 243 is a passage through which foods are taken in or out of an accommodation space 263 of a home bar housing 261 to be explained later. The home bar opening 243 is formed by cutting out the center of the home bar frame portion 241 in a rectangular shape.

In addition, a stepped portion 245 is formed at a front end on a peripheral edge surface of the home bar opening 243. The stepped portion 245 is formed in such a way that the opposite edge surfaces of the home bar opening 243 are away from each other. That is, the stepped portion is brought into close contact with a peripheral edge surface of a home bar door 267 to be explained later.

Meanwhile, the display mounting portion 247 is provided at one side of the home bar frame portion 241, i.e. above the home bar opening 243. The display mounting portion 247 is used for mounting the display 250 to the refrigerator door. The display mounting portion 247 is formed by depressing a portion of the home bar frame portion 241 in a right direction on the figure to correspond to the shape of the display 250.

As shown in FIG. 4, the display 250 is provided to one of the doors 220 and 230. The display 250 receives a variety of operation signals for the refrigerator and displays a variety of operating information for the refrigeration. In this embodiment, the display 250 is provided to the left door 220 on the figure among the doors 220 and 230.

As shown in FIG. 6, the display 250 includes a PCB 251 and a display cover 253. The PCB 251 is provided with a plurality of buttons used to receive operation signals for the refrigerator and an LCD for on which a variety of operating information for the refrigerator is displayed. In addition, various texts and images are printed on the display cover 253 for indicating the buttons, and a display window is formed at a position corresponding to the LCD. The display 250 receives operation signals for the refrigerator in touch screen mode.

In addition, a home bar 260 is provided to one or both of the doors 220 and 230. The home bar 260 is used for allowing a user to take the received foods out of the accommodation space without opening the doors 220 and 230. The home bar 260 is configured to include a home bar housing 261 and a home bar door 267.

The home bar housing 261 is installed to the rear surface of the door 220. The accommodation space 263 is provided in the home bar housing 261 such that it is opened toward the rear surface of the door 220, i.e. in a right direction on the figure. Further, a cold air opening 265 through which cold air is supplied into the accommodation space 263 is formed at a portion of the home bar housing 261.

The home bar housing 261 is mounted to the rear surface of the door 220 such that the opened front surface thereof can be aligned with the home bar opening 243. For example, the home bar housing 261 may be mounted in the same way as a door basket provided to the rear surface of the door 220.

As shown in FIGS. 4 and 6, the home bar door 267 serves to selectively open or close the home bar opening 243 and substantially the accommodation space 263. The home bar door 267 is configured to selectively open or close the home bar opening 243 in such a manner that an upper end thereof pivotally moves with respect to a lower end thereof.

The outer cover member 228 defines the front external appearance of the door 220. One or more sheets of glass or transparent members may be used as the outer cover member 228. The back side of the outer cover member 228 is brought into close contact with the front surface of the home bar frame portion 241 and the front surface of the outdoor 222 except the home bar opening 243, so that the display mounting portion 247 to which the display 250 is mounted is be substantially covered.

Hereinafter, a process of manufacturing the refrigerator door equipped with the display mounting structure according to another embodiment of the present invention will be described.

First, the fixing rib 223 is fitted into the fixing channel 242 to couple the outdoor 222 and the mounting frame 240 with each other. Further, the cap decorations 225 and the side decorations 226 are coupled to both top and bottom ends and both side ends of the outdoor 222, and foaming liquid is then sprayed into a space defined by rear surfaces of the mounting frame 240 and the outdoor 221 and inner surfaces of the cap decorations 225 and the side decorations 226. If the sprayed foaming liquid is solidified into the insulation layer 227, then the door liner 224 is coupled to the rear of the outdoor 222.

Furthermore, the display 250 is mounted to the display mounting portion 247. At this time, the display 250 is preferably mounted to the display mounting portion 247 in a state where the PCB 251 and the display cover 253 are coupled to each other. Of course, the PCB 251 is coupled to the display mounting portion 247 and the display cover 253 is then coupled to the PCB 251. Further, the display 250 may be previously mounted to the display mounting portion 247 before the mounting frame 240 is coupled to the outdoor 221.

If the display 250 has been completely mounted as mentioned above, the outer cover member 228 is installed to the front surface of the outdoor 221 of the door. Then, the home bar housing 261 is installed to the door liner 224 and the home bar door 267 for selectively opening or closing the accommodation space 263 of the home bar housing 261 is installed. Thus, the manufacture of the door 220 is finished. Of course, an order of installing the outer cover member 228, the home bar housing 261 and the home bar door 267 may be changed, if desired, for convenience of a worker.

INDUSTRIAL APPLICABILITY

A display for a refrigerator, a display mounting frame and a display mounting structure including the same according to the present invention so configured have the following advantages.

First, according to the present invention, a previously fabricated display is mounted to a display mounting portion of a mounting frame. Therefore, errors occurring in the process of installing the display, e.g. installation position errors, can be prevented, and thus, the percentage defective of the display can be lowered and the operating reliability of products can be improved.

Further, a process of manufacturing products can be substantially simplified. Therefore, costs needed to manufacture the products can also be reduced.

According to the present invention, the display may be separated from the display mounting portion to repair or exchange the display. Therefore, convenient maintenance of the products can be ensured.

Moreover, according to the present invention, a home bar frame portion for forming the home bar opening and a display mounting portion for mounting the display are formed into a single member. Therefore, the manufacturing process can be simplified and the manufacture costs can also be reduced.

The invention claimed is:

1. A display for a refrigerator, comprising:

a display case mounted to a display mounting portion provided to a front surface of a refrigerator door and provided with a predetermined installation space therein;

a printed circuit board (PCB) installed to the display case and including an input portion for receiving various operation signals for the refrigerator and a display portion for displaying a variety of operating information for the refrigerator; and a display cover provided to one side of the PCB and defining a front surface of the display, wherein the display mounting portion is integrally formed with a mounting frame which includes a home bar frame portion provided to the door to define a home bar opening.

2. The display as claimed in claim 1, wherein at least one through hole through which a fastener coupled to the display mounting portion penetrates is formed at one side of the display case.

3. The display as claimed in claim 1, wherein a male or female connector is provided to a position on the display case such that the male or female connector is connected to a corresponding female or male connector provided to the display mounting portion and thus connected to a main controller of the refrigerator.

4. A mounting frame for a display in a refrigerator, comprising:

a home bar frame portion provided to a refrigerator door and formed with a home bar opening through which foods are taken in or out of a home bar; and a display mounting portion provided to one side of the home bar frame portion and mounted with the display which is provided to the refrigerator door to receive various operation signals for the refrigerator and display operating information for the refrigerator, wherein the mounting frame is mounted to a cut-out portion formed by cutting out a portion of a front surface of the door, and a front surface of the home bar frame portion is brought into close contact with a back side of an outer cover member which is provided to a front surface of an outdoor.

5. The display mounting frame as claimed in claim 4, wherein the display receives operation signals for the refrigerator in touch screen mode.

6. The display mounting frame as claimed in claim 4, wherein the home bar opening communicates with an accommodation space defined in a home bar housing provided to a rear surface of the door.

7. The display mounting frame as claimed in claim 4, wherein the display mounting portion is formed into a shape corresponding to the display by depressing a portion of the home bar frame portion inwardly of the door and is covered with an outer cover member provided to a front surface of the door.

8. The display mounting frame as claimed in claim 4, wherein a female or male connector is provided to a position on the display mounting portion such that the female or male connector is connected to a corresponding male or female connector provided to the display to connect the display to a main controller of the refrigerator.

9. The display mounting frame as claimed in claim 4, wherein in a state where the display mounting portion is covered with an outer cover member provided to a front surface of an outdoor, a front surface of the home bar frame portion is brought into close contact with a back side of the outer cover member.

10. A display mounting structure, comprising:

a display for receiving various operation signals for a refrigerator and displaying operating information for a refrigerator, the display comprising:

a display case mounted to a display mounting portion provided to a front surface of a refrigerator door and provided with a predetermined installation space therein;

a printed circuit board (PCB) installed to the display case and including on input portion for receiving various operation signals for the refrigerator and a display portion for displaying a variety of operating information for the refrigerator; and a display cover provided to one side of the PCB and defining a front surface of the display; and a mounting frame for mounting the display, the mounting frame comprising:

a home bar frame portion provided to a refrigerator door and formed with a home bar opening through which foods are taken in or out of a home bar; and a display mounting portion provided to one side of the home bar frame portion and mounted with the display which is provided to the refrigerator door to receive various operation signals for the refrigerator and display operating information for the refrigerator, wherein the mounting frame is mounted to a cut-out portion formed by cutting out a portion of a front surface of the door, and a front surface of the home bar frame portion is brought into close contact with a back side of an outer cover member which is provided to a front surface of an outdoor.

* * * * *